US007252175B2

(12) United States Patent
Suzuki

(10) Patent No.: US 7,252,175 B2
(45) Date of Patent: Aug. 7, 2007

(54) SPEAKER APPARATUS AND MANUFACTURING METHOD OF SPEAKER APPARATUS

(75) Inventor: Tatsuya Suzuki, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 149 days.

(21) Appl. No.: 11/033,730

(22) Filed: Jan. 13, 2005

(65) Prior Publication Data

US 2005/0167187 A1 Aug. 4, 2005

(30) Foreign Application Priority Data

Feb. 4, 2004 (JP) ..... P2004-027919

(51) Int. Cl.
*F15D 1/02* (2006.01)

(52) U.S. Cl. ..... 181/156; 181/148; 181/199; 181/152; 181/198; 381/345; 381/349; 381/341

(58) Field of Classification Search ..... 181/156, 181/148, 199, 152, 198; 381/345, 349, 341
See application file for complete search history.

(56) References Cited

U.S. PATENT DOCUMENTS

| | | | | |
|---|---|---|---|---|
| 3,925,616 | A * | 12/1975 | Sondhi | 704/201 |
| 4,901,816 | A * | 2/1990 | Garey | 181/296 |
| 5,313,525 | A * | 5/1994 | Klasco | 381/350 |
| 5,898,788 | A * | 4/1999 | Kim | 381/341 |
| 6,866,116 | B2 * | 3/2005 | Peng | 181/199 |
| 2001/0037910 | A1 * | 11/2001 | Coffin | 181/199 |

FOREIGN PATENT DOCUMENTS

JP 5-268686 A 10/1993

* cited by examiner

*Primary Examiner*—Lincoln Donovan
*Assistant Examiner*—Forrest Phillips
(74) *Attorney, Agent, or Firm*—Sughrue Mion, PLLC

(57) ABSTRACT

A speaker apparatus is a bass-reflex type woofer used in a speaker system, and includes a body portion for housing a speaker unit and a bass-reflex port mounted and fixed in the body portion. Further, in the speaker apparatus, a protrusion for temporarily fastening the bass-reflex port in the case of mounting and fixing the bass-reflex port is provided in the body portion.

5 Claims, 7 Drawing Sheets

SPEAKER APPARATUS AND MANUFACTURING METHOD OF SPEAKER APPARATUS

CROSS-REFERENCE TO RELATED APPLICATION

The invention claims priority to Japanese Patent Application No. JP 2004-027919 filed on Feb. 4, 2004. The disclosure of the prior application is incorporated herein by reference in its entirety.

BACKGROUND OF THE INVENTION

1. Field of the Invention

The present invention relates to a speaker apparatus and a manufacturing method of the speaker apparatus.

2. Description of the Related Art

Generally, in a speaker system, there are cases where a woofer of bass-reflex structure is used for improving reproducing characteristics of a bass range.

FIG. 1 is a partially enlarged sectional view of a conventional bass-reflex type speaker.

As shown in FIG. 1, a bass-reflex port 101 for outputting a bass range is mounted in a bass-reflex type speaker 100.

This bass-reflex port 101 is a substantially cylindrical resin molded product whose ends are both opened in circular shape. A flange portion 102 for fixing is provided in one end of the bass-reflex port 101, and this flange portion 102 is mounted in the outer circumference 110*b* of an opening 110*a* formed in a chassis 110 of the bass-reflex type speaker 100 with the flange portion fixed by screwing etc. Also, the other end 103 of the bass-reflex port 101 has a horn shape in which an inside diameter increases as approaching the other end in order to send sound outputted from a speaker unit to the inside of the bass-reflex port efficiently (refer to JP-A-5-268686, for example).

SUMMARY OF THE INVENTION

Generally, a bass-reflex port has a substantially cylindrical shape and further has a horn shape on an other end, so that a position of the bass-reflex port to a chassis is difficult to determine until the bass-reflex port is fully fixed in the chassis by screwing etc. Particularly, the bass-reflex port is a kind of elongated member, so that the end opposite to the fixed side tends to lower downward due to its own weight inevitably. Therefore, in a case of mounting the bass-reflex port in the chassis, a worker needs to perform screwing after the bass-reflex port is aligned with the chassis using hand or a special jig. Thus, in the case of mounting the bass-reflex port in the chassis, the worker must pay attention to maintenance of a positioning state even after positioning, and the bass-reflex port could not be mounted in the chassis efficiently.

As problems of the invention, for example, a problem that the bass-reflex port cannot be mounted in the chassis efficiently is raised.

According to an embodiment of the invention, there is provided a speaker apparatus including a body portion which houses a speaker unit; a bass-reflex port mounted and fixed in the body portion; and a temporary fastening portion provided in the body portion for temporarily fastening the bass-reflex port in a case of mounting and fixing the bass-reflex port in the body portion.

Also, according to an embodiment of the invention, there is provided a manufacturing method of a speaker apparatus comprising steps of placing a bass-reflex port on a temporary fastening portion and a bass-reflex port mounting portion formed on a body portion of the speaker apparatus, and fixing the bass-reflex port in the body portion in a state where the bass-reflex port is temporarily fastened by the temporary fastening portion.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Embodiments of a speaker apparatus according to the invention and a manufacturing method of the speaker apparatus will be described below.

A speaker apparatus according to an embodiment of the invention is a speaker apparatus having a body portion for housing a speaker unit and a bass-reflex port mounted and fixed in the body portion, and a temporary fastening portion for temporarily fastening the bass-reflex port in a case of mounting and fixing the bass-reflex port is provided in the body portion.

According to the embodiment, the bass-reflex port is positioned on the body portion by only placing the bass-reflex port on the body portion. Therefore, a worker who mounts the bass-reflex port in the body portion can fix the bass-reflex port in the body portion regardless of a position relation between the bass-reflex port and the body portion, that is, without making efforts to position the bass-reflex port on the body portion. Consequently, the bass-reflex port and the body portion can efficiently be assembled to improve production efficiency.

Specifically, one example shows that the temporary fastening portion is a protrusion formed on an inner surface of the body portion.

Also, in the embodiment, a rotation restraint portion for restraining rotation of the bass-reflex port in a state where the bass-reflex port is placed from above of the body portion is provided. As this rotation restraint portion, for example, it is configured with plural engagement grooves formed in the bass-reflex port and plural protrusions formed on the body portion respectively corresponding to the plural engagement grooves, and rotation of the bass-reflex port is restrained by engaging the protrusions with the engagement grooves.

Therefore, according to the embodiment, the bass-reflex port is positioned on the body portion by only placing the bass-reflex port on the body portion, and a worker can easily fix the bass-reflex port in the body portion without paying any attention to a rotation direction of the bass-reflex port.

EXAMPLE

Specific examples of a speaker apparatus according to the invention and a manufacturing method of the speaker apparatus will be described below in detail with reference to the drawings.

Figure 1:
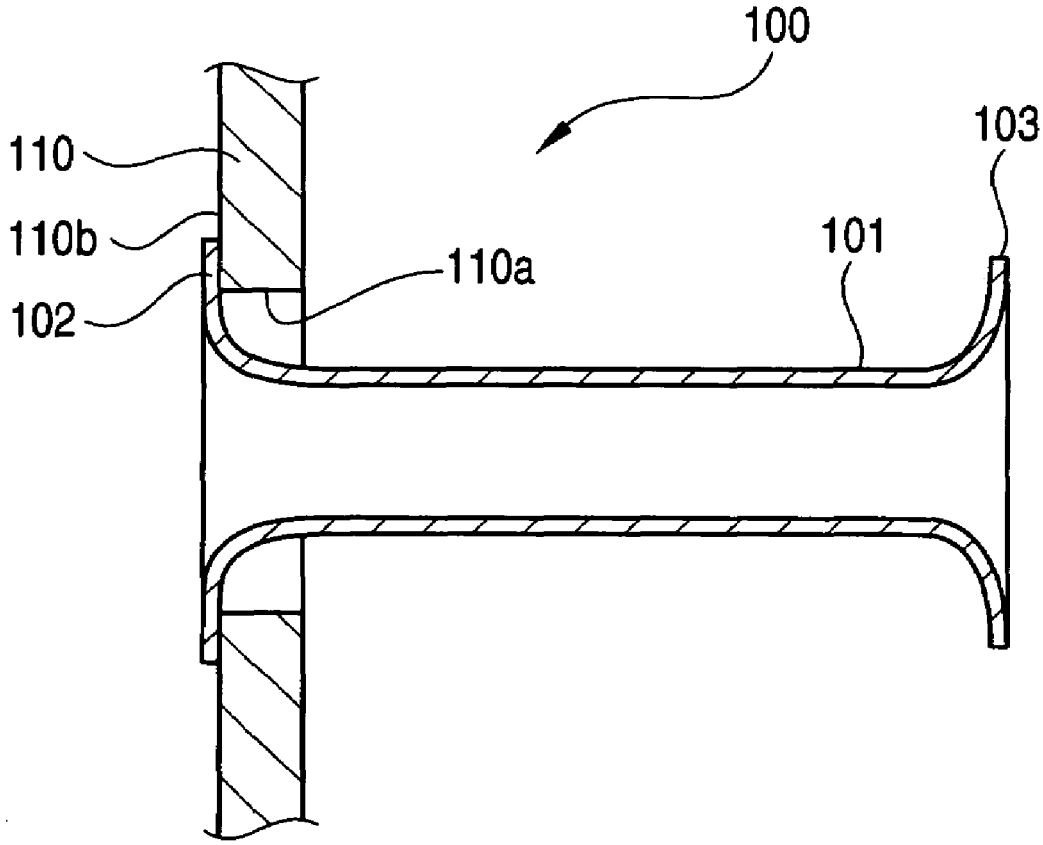
FIG. 1 PRIOR ART
FIG. 1 is a partially enlarged sectional view of a conventional bass-reflex type speaker.
Figure 2:
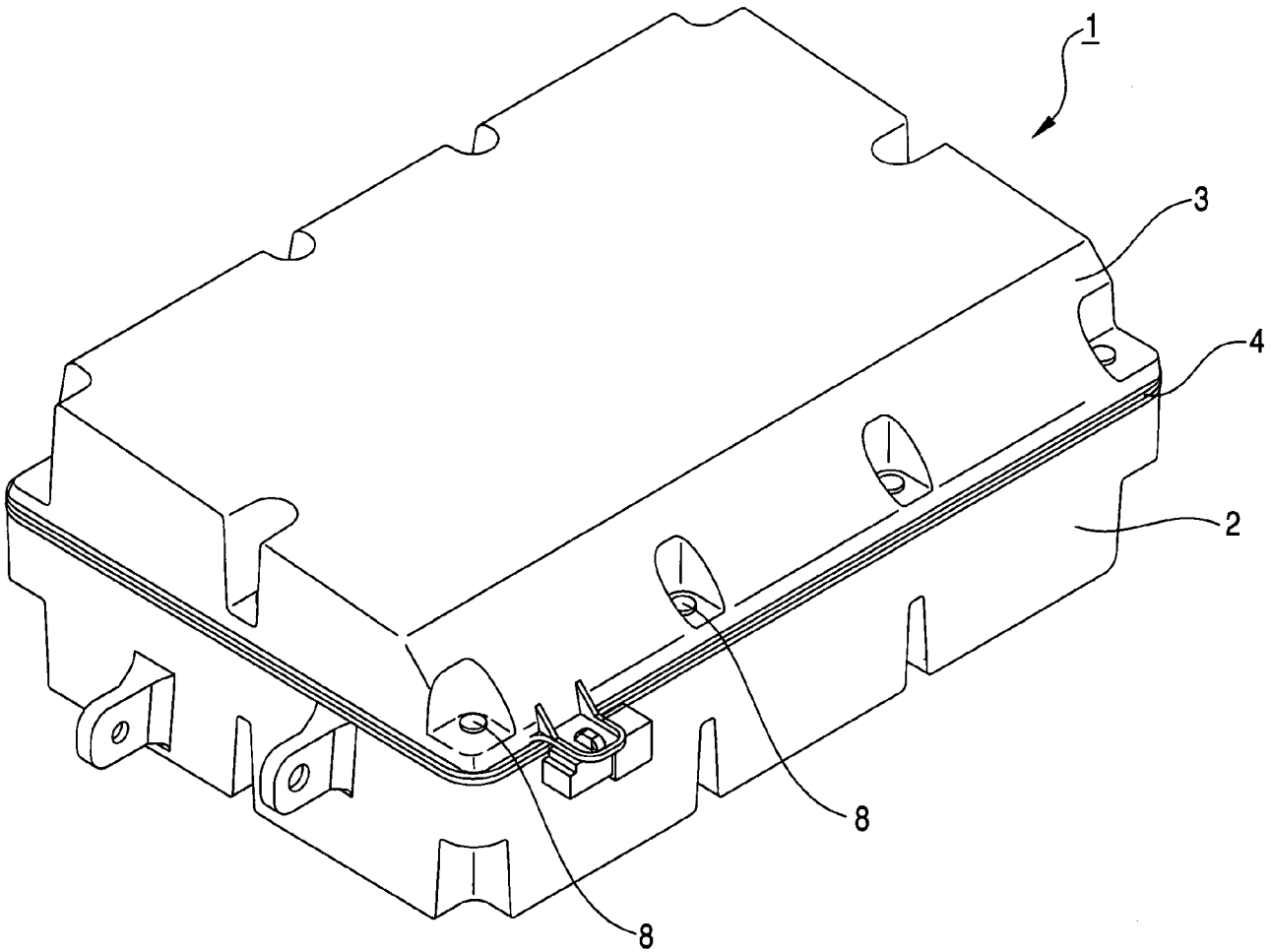
FIG. 2 is a perspective view of a speaker apparatus of the present example.
Figure 3:
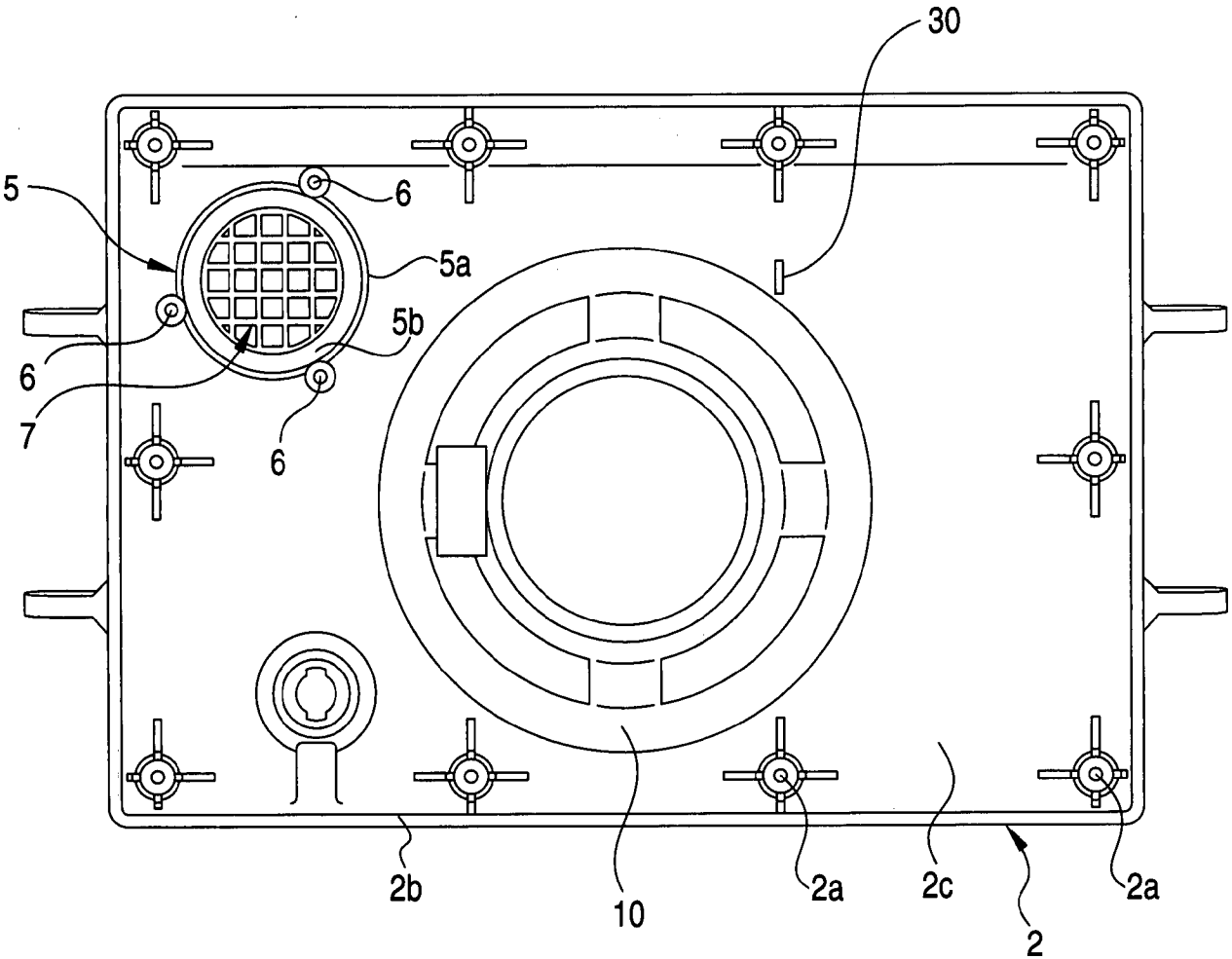
FIG. 3 is a top view showing a body portion of the speaker apparatus.
Figure 4:
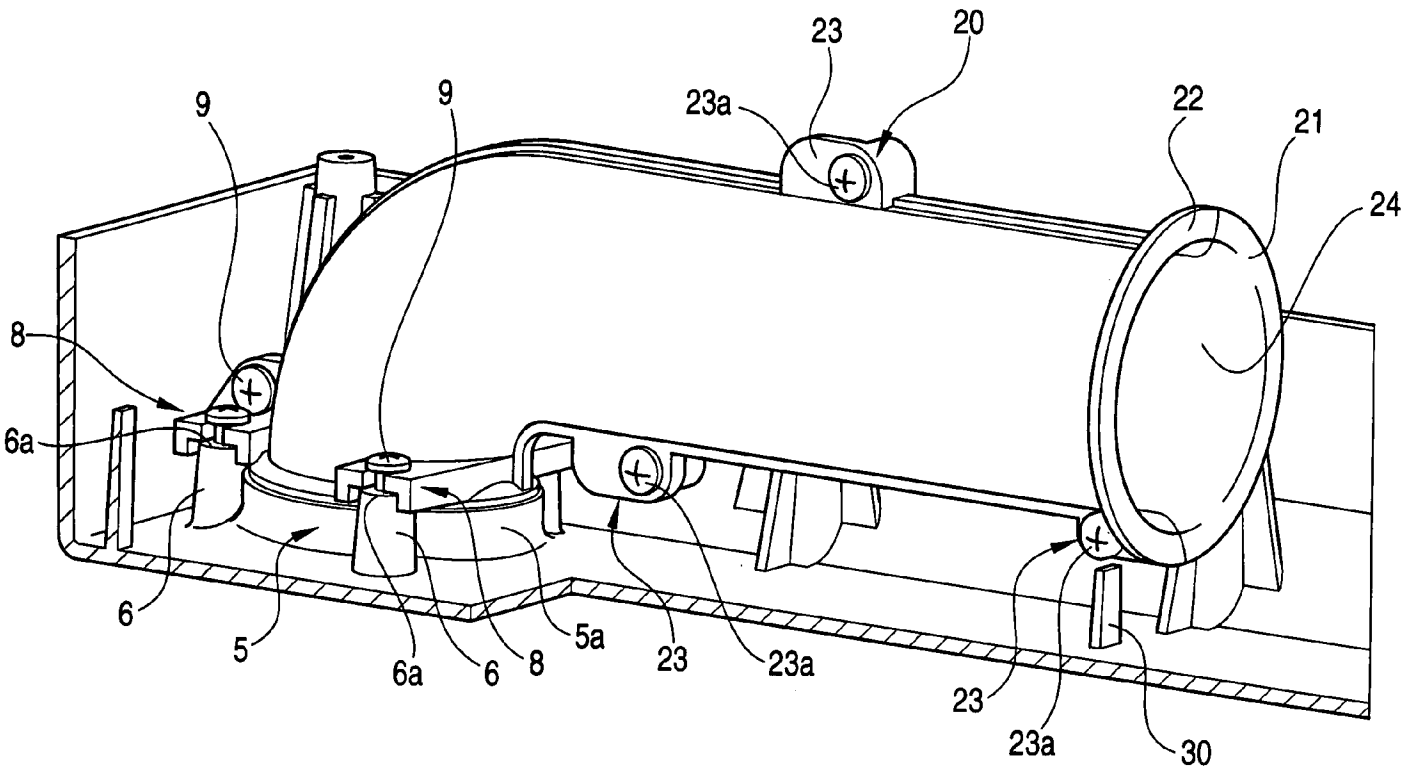
FIG. 4 is a perspective view showing a state in which a bass-reflex port is mounted.
Figure 5:
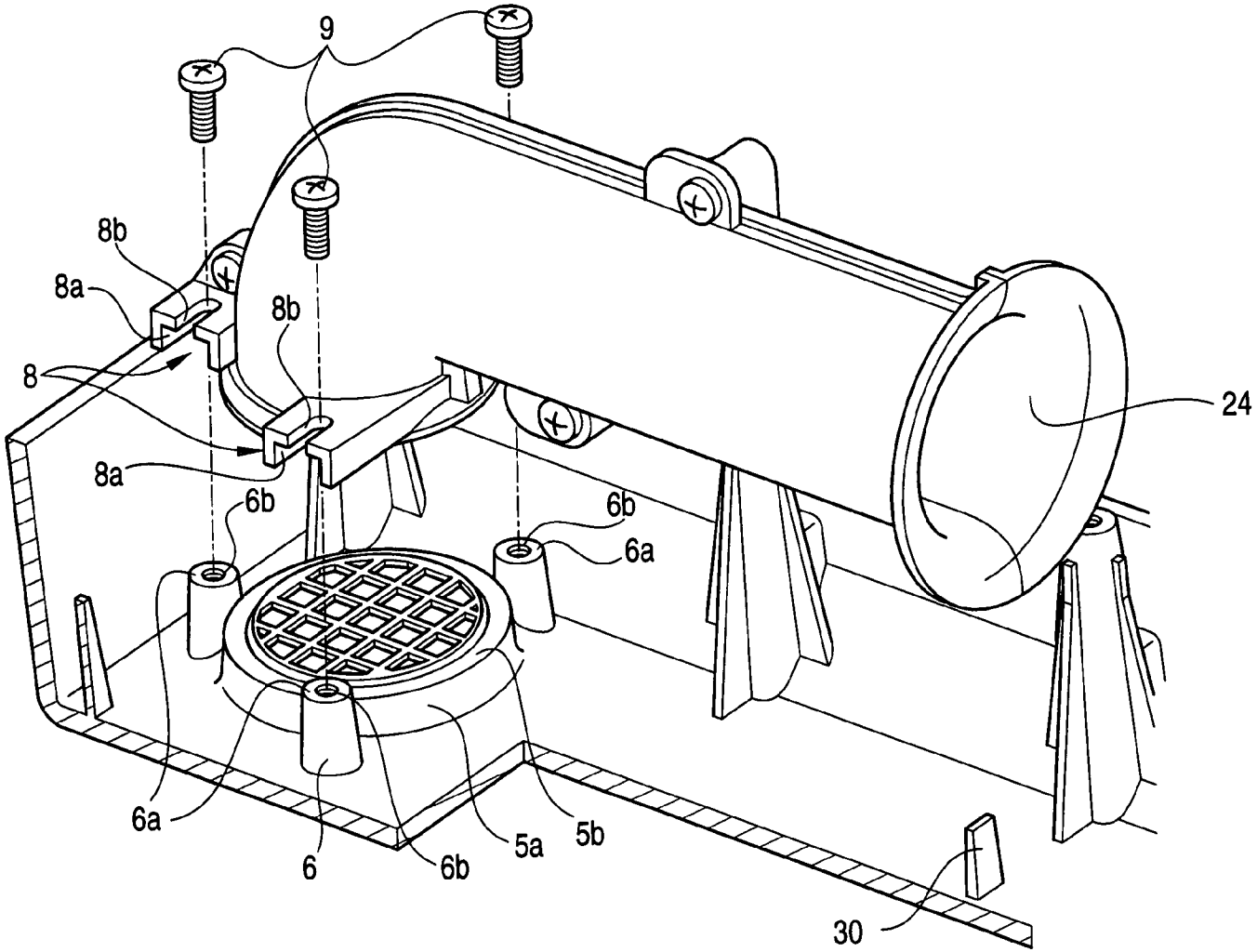
FIG. 5 is a perspective view showing mounting of the bass-reflex port.
Figure 6:
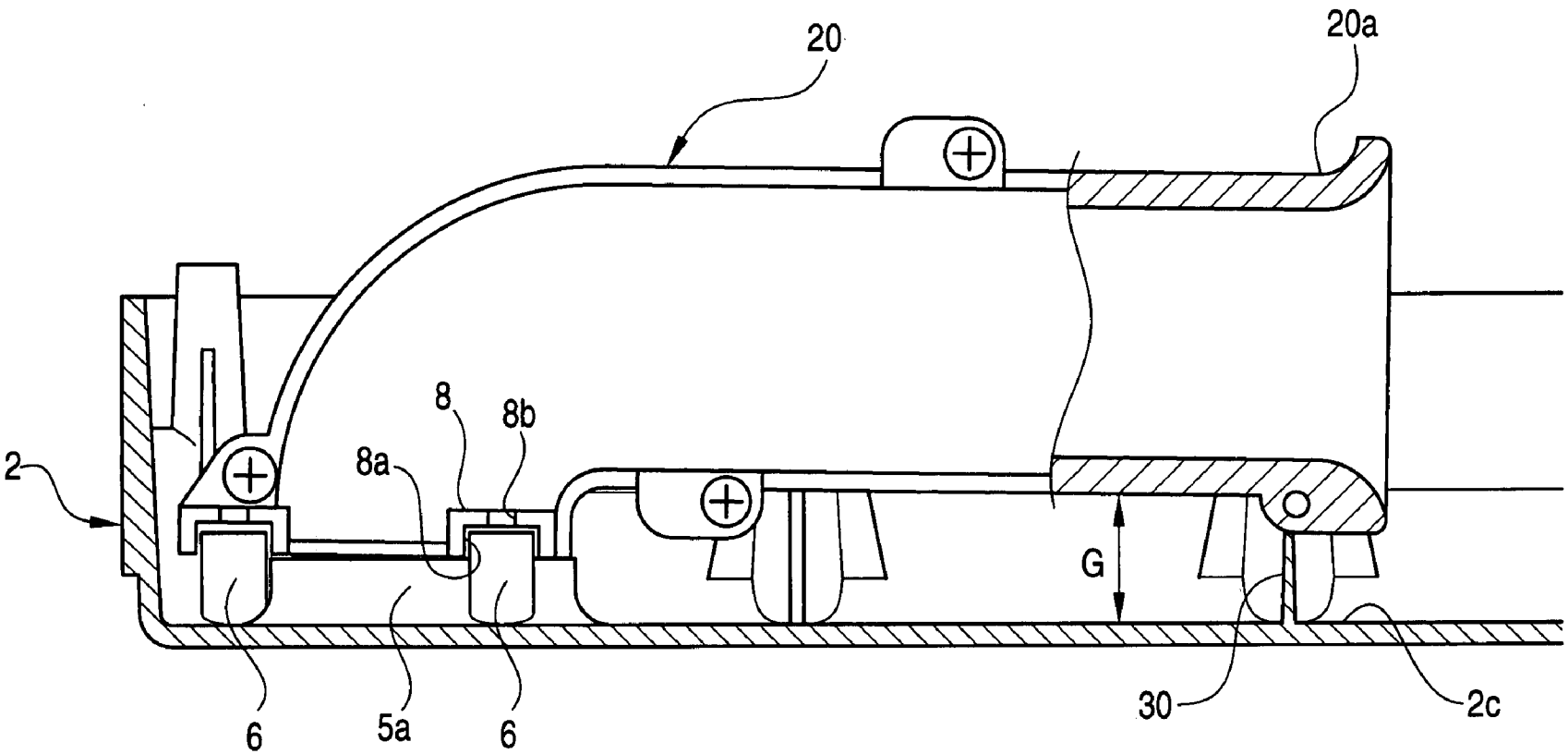
FIG. 6 is a view showing a state in which the bass-reflex port is temporarily fastened.

FIG. 2 is a perspective view of a speaker apparatus of the present example, and FIG. 3 is a top view showing a body portion of the speaker apparatus, and FIG. 4 is a perspective view showing a state in which a bass-reflex port is mounted, and FIG. 5 is a perspective view showing mounting of the bass-reflex port, and FIG. 6 is a view showing a state in which the bass-reflex port is temporarily fastened.

A speaker apparatus 1 of the example is so-called bass-reflex type woofer used for reproduction of a bass range in a speaker system, and a body portion 2 and a lid portion 3 are positioned and fixed in a form of sandwiching a seal portion 4, and a chassis of the speaker apparatus 1 is constructed.

As shown in FIG. 3, in the body portion 2, plural bosses 2*a* are formed along the inner surface side of a side wall 2*b*. The bosses 2*a* are screw receiving portions in a case of fixing the lid portion 3 in the body portion 2, and plural screws 8 are inserted from the upper surface side of the lid portion 3 toward the body portion 2 through the lid portion 3 and are tightened in the bosses 2*a* and thereby the lid portion 3 and the body portion 2 are fixed.

A speaker unit 10 is installed in the body portion 2. This speaker unit is a reproduction unit for reproducing sound according to an output signal from an amplifier (not shown), and the sound is outputted to the outside of the speaker apparatus 1 through an opening (not shown) formed in the bottom 2*c* of the body portion 2.

Also, as shown in FIGS. 3 and 4, a bass-reflex port mounting portion 5 in which a bass-reflex port 20 described below is mounted is formed in the body portion 2. The bass-reflex port mounting portion 5 is configured with a pedestal 5*a* with substantially circular shape viewed from an upper surface integrally formed in the bottom 2*c* of the body portion 2. An opening portion 7 opened in lattice shape is formed in an upper surface 5*b* of this pedestal 5*a* and also plural bosses 6 for bass-reflex port mounting for fixing the bass-reflex port 20 are formed at predetermined intervals in the outer circumference of the pedestal 5*a*. The tops 6*a* of the bosses 6 for bass-reflex port mounting are formed in protrusions protruding upward from the upper surface 5*b* of the pedestal 5*a* and screw holes 6*b* for screwing are respectively formed in each of the tops 6*a*.

The bass-reflex port 20 is an elongated cylindrical resin molded product having substantially L shape. This bass-reflex port 20 includes a first member 21 and a second member 22 having shape in which the bass-reflex port 20 is divided in a longitudinal direction, and the first member 21 and the second member 22 are aligned and fixed in plural fixed portions 23 by screws 23*a*, respectively and are configured as the integral bass-reflex port 20.

Also, as shown in FIG. 5 in detail, one end of the bass-reflex port 20 is provided with plural mounting portions 8 in positions corresponding to the plural bosses 6 for bass-reflex port mounting provided in the circumference of the pedestal 5*a*. An engagement groove 8*a* for engaging with the top 6*a* of the boss 6 for bass-reflex port mounting and a screw groove 8*b* for mounting the bass-reflex port 20 in the boss 6 are respectively formed in each of the mounting portions 8.

When the bass-reflex port 20 is aligned from above of the pedestal 5*a*, the tops 6*a* of the bosses 6 for bass-reflex port mounting are fitted into the engagement grooves 8*a* of each of the mounting portions 8. As a result of this, the bass-reflex port 20 is configured so that rotation using the normal to the upper surface 5*b* of the pedestal 5*a* as the axis is restrained and the screw holes 6*b* of the bosses 6 are positioned to the screw grooves 8*b* of the mounting portions 8 by only aligning the bass-reflex port 20 from above of the pedestal 5*a*. By screwing screws 9 into the screw holes 6*b* through the screw grooves 8*b* in this state, the bass-reflex port 20 is tightened and fixed in the pedestal 5*a*. An opening 24 of the bass-reflex port 20 is communicated to the opening portion 7 opened in the upper surface 5*b* of the pedestal 5*a* and sound of the speaker unit 10 is emitted to the outside through the bass-reflex port 20.

In the example, a protrusion 30 corresponding to the vicinity of the side of the opening 24 of the bass-reflex port 20 is formed on the bottom 2*c* of the body portion 2. This protrusion 30 is for temporarily fastening the bass-reflex port 20 without screwing by abutting on the bass-reflex port 20 with the bass-reflex port 20 placed on the pedestal 5*a* from above. A protrusion length of this protrusion 30 is set at such a length as to be temporarily fastened in a slightly inclined state with the bass-reflex port 20 placed on the pedestal 5*a*.

That is, with the bass-reflex port 20 placed on the pedestal 5*a* from above, a gap G is present between the opening side top 20*a* of the bass-reflex port 20 and the bottom 2*c* of the body portion 2, so that a way for compensating shape of the bass-reflex port 20 and the pedestal 5*a* so as to fill this gap G is this protrusion 30.

Figure 7:
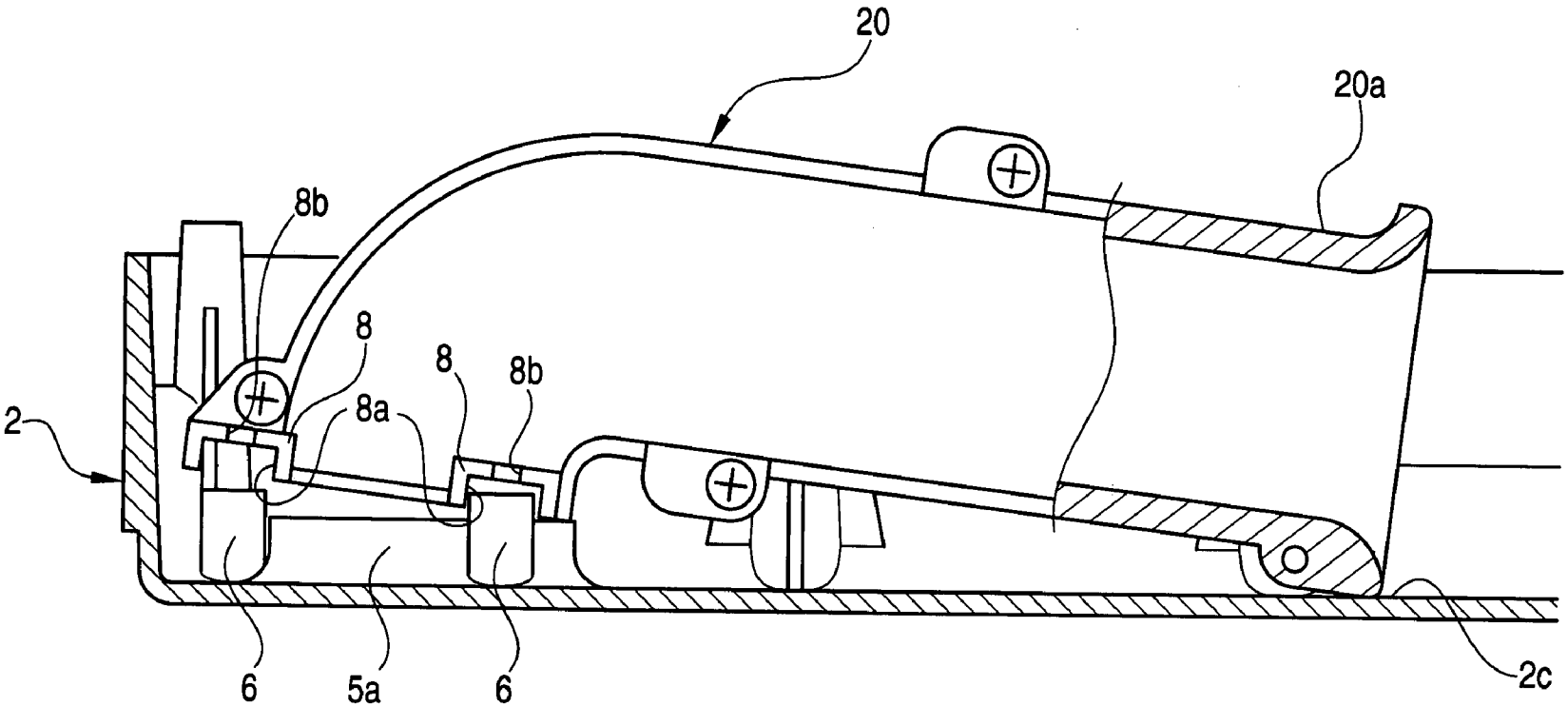
FIG. 7 is a view describing mounting of the case that there is no protrusion.

Description will be made by taking FIG. 7 as an example. When the bass-reflex port 20 is placed on the pedestal 5*a* from above in a case where there is not this protrusion 30, due to the own weight of the bass-reflex port 20, the opening side top 20*a* of the bass-reflex port 20 inclines and lowers downward and abuts on the bottom 2*c* of the body portion 2. In this state, engagement of the screw holes 6*b* of the bosses 6 with the screw grooves 8*b* of the mounting portions 8 deviates from a vertical direction, and some cases lead to a situation in which the bass-reflex port 20 turns and topples, and the screw holes 6*b* of the bosses 6 cannot be positioned to the screw grooves 8*b* of the mounting portions 8. In order to solve this, the screw holes 6*b* of the bosses 6 could be positioned to the screw grooves 8*b* of the mounting portions 8 using hand or a special jig, but a worker must make efforts to maintain the positioning and manufacturing efficiency is not good.

However, according to the example, the protrusion 30 prevents inclination of the opening side top 20*a* of the bass-reflex port 20, so that engagement of the screw holes 6*b* of the bosses 6 with the screw grooves 8*b* of the mounting portions 8 does not deviate from a vertical direction and the screw holes 6*b* of the bosses 6 can be positioned to the screw grooves 8*b* of the mounting portions 8 by only placing the bass-reflex port 20 on the pedestal Sa from above without using hand or a special jig. Therefore, a worker can concentrate on screwing without making efforts to maintain the positioning of the bass-reflex port 20 and the body portion 2 and the bass-reflex port 20 can efficiently be mounted in the body portion 2.

In the case of summarizing mounting of the bass-reflex port 20 in the speaker apparatus 1 of the example described above, the mounting is as follows.

First, the bass-reflex port 20 is placed on the protrusion 30 and the bass-reflex port mounting portion 5 formed on the body portion 2 of the speaker apparatus 1 and the bass-reflex port 20 is temporarily fastened on the body portion 2 of the speaker apparatus 1. The screw holes 6*b* of the bosses 6 are positioned to the screw grooves 8*b* of the mounting portions 8 in a state where the bass-reflex port 20 is temporarily fastened by the protrusion 30. By fastening screws 9 in the screw holes 6*b* of the bosses 6 through the screw grooves 8*b* of the mounting portions 8 in this state, the bass-reflex port 20 is fully fixed on the body portion 2 of the speaker apparatus 1.

According to the example thus, the bass-reflex port 20 is positioned to the bass-reflex port mounting portion 5 formed on the body portion 2 of the speaker apparatus 1 by only placing the bass-reflex port 20 on the protrusion 30 and the bass-reflex port mounting portion 5 formed on the body portion 2 of the speaker apparatus 1. Therefore, a worker can easily position and fix the bass-reflex port 20 without temporarily fastening the bass-reflex port using a special jig or holding the bass-reflex port 20 by hand, and the speaker apparatus 1 can be manufactured efficiently.

Incidentally, in the example, the case of screwing for fixing has been described, but it is not limited to this, and it may be configured so as to fix the bass-reflex port 20 in the body portion 2 using another fixing ways.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A speaker apparatus comprising:

a body portion which houses a speaker unit;

a bass-reflex port mounted and fixed in the body portion; and a temporary fastening portion provided in the body portion for temporarily fastening the bass-reflex port in a case of mounting and fixing the bass-reflex port on an upper surface in the body portion, wherein the temporary fastening portion is a protrusion formed on an inner surface of the body portion.

2. The speaker apparatus according to claim 1, further comprising a rotation restraint portion for restraining rotation of the bass-reflex port in a state where the bass-reflex port is placed on the body portion.

3. The speaker apparatus according to claim 2, wherein the rotation restraint portion is configured with plural engagement grooves formed in the bass-reflex port and plural protrusions formed on the body portion respectively corresponding to the plural engagement grooves, and rotation of the bass-reflex port is restrained by engaging the protrusions with the engagement grooves.

4. A manufacturing method of a speaker apparatus, comprising steps of:

placing a bass-reflex port on an upper surface of a temporary fastening portion and a bass-reflex port mounting portion formed on a body portion of the speaker apparatus, and fixing the bass-reflex port in the body portion in a state where the bass-reflex port is temporarily fastened by the temporary fastening portion, wherein the temporary fastening portion is a protrusion formed on an inner surface of the body portion.

5. The manufacturing method of a speaker apparatus according to claim 4, wherein the bass-reflex port is fixed in the body portion in a state where rotation of the bass-reflex port is restrained by engaging plural engagement grooves formed in the bass-reflex port with plural protrusions formed on the body portion respectively corresponding to the plural engagement grooves.

* * * * *